United States Patent [19]

Nakanishi

[11] Patent Number: 4,725,052

[45] Date of Patent: Feb. 16, 1988

[54] PAPER DISCHARGING DEVICE HAVING CONVEYOR SECTIONS MOVING AT DIFFERENT SPEEDS

[75] Inventor: Tomoyuki Nakanishi, Moriyama, Japan

[73] Assignee: Omron Tateisi Electronics Co., Kyoto, Japan

[21] Appl. No.: 887,187

[22] Filed: Jul. 21, 1986

[30] Foreign Application Priority Data

Jul. 22, 1985 [JP] Japan ..... 60-112575[U]

[51] Int. Cl.[4] ..... B65H 1/08; B65H 1/02

[52] U.S. Cl. ..... 271/126; 271/150; 414/330; 198/415

[58] Field of Search ..... 271/31.1, 109, 113, 271/119, 126, 129, 147, 148, 149, 150, 151, 167, 34; 414/330; 198/415

[56] References Cited

U.S. PATENT DOCUMENTS

| | | | |
|---|---|---|---|
| 2,361,907 | 11/1944 | Baker et al. | 271/151 X |
| 2,554,578 | 5/1951 | Lauffer | 271/150 X |
| 2,554,579 | 5/1951 | Lauffer | 271/150 |
| 2,637,433 | 5/1953 | Shuttleworth | 198/415 |
| 3,459,420 | 8/1969 | Huntwork | 271/150 |

FOREIGN PATENT DOCUMENTS

| | | | |
|---|---|---|---|
| 0089530 | 5/1983 | Japan | 271/31.1 |
| 917754 | 2/1963 | United Kingdom | 271/150 |

OTHER PUBLICATIONS

Johnson et al., "Edge Feed Loader for Mail Transport", IBM Tech. Disclosure Bulletin, vol. 19, No. 2, Jul. 1976, pp. 623–624.

*Primary Examiner*—Joseph J. Rolla
*Assistant Examiner*—Edward S. Ammeen
*Attorney, Agent, or Firm*—Stevens, Davis, Miller & Mosher

[57] ABSTRACT

To carry bills in a bill container in a correct rearward inclined position, the bills are carried by first belts at the rear half of the container but by second belts at the front half of the container. Since the second belts are driven at a speed higher than that of the first belts, the bills carried to the discharging roller are arranged at a correctly rearward inclined position before the succeeding discharge operation.

2 Claims, 2 Drawing Figures

PAPER DISCHARGING DEVICE HAVING CONVEYOR SECTIONS MOVING AT DIFFERENT SPEEDS

BACKGROUND OF THE INVENTION

1. Field of the Invention

The present invention relates to a device for discharging one by one accommodated papers such as bills, slips, securities, standard form papers, etc., and in more specifically to a bill discharging device assembled with a bill container for accommodating bills to be discharged and/or bills deposited. The bill discharging device and the bill container are incorporated in an automated cash depositing and dispensing machine (an automated teller machine), an automated cash exchanging machine, etc. which are equipped in banks, financiers or other stores.

2. Description of the Prior Art

The structure of the paper discharging device as described above will be explained by taking the case of a bill discharging device.

The bill discharging device is assembled with a bill container. The device is provided with bill carrying belts for receiving, supporting and carrying bills. The bills are arranged in a standing state on the bill carrying belts. On the front lower side of the carrying belt, there is arranged a bill discharging roller for discharging a forefront bill one by one. An auxiliary roller is disposed at the rear upper position of the discharging roller. In order to ensure a good discharging performance of the accommodated bills, the bills mounted on the carrying belts are held at an inclined position with the top end of bills shifted rearward (rearward-inclined position). To support the bills as described above, a rearward-inclined bill press plate is arranged to urge the bills in the frontward direction.

The bill tends to be vibrated when the discharging roller rotates or other movable parts move. Therefore, the bills supported on the carrying belts in an inclined state sometimes stand up almost vertically, thus resulting in a problem in that the forefront bill is not appropriately brought into contact with the discharging roller and/or the auxiliary roller and therefore no bill is discharged or two bills are discharged simultaneously or jamming (bill clogging) occurs.

SUMMARY OF THE INVENTION

The object of the present invention is to provide a paper discharging device which can reliably discharge papers one by one, that is, prevent the above-mentioned lost discharge motion, two superposed paper discharge, paper jamming, etc. in such a way as to previously prevent the paper from being raised up almost vertically or to readily correct the vertically raised-up paper to an appropriate rearward-inclined position suitable for the succeeding discharge operation with the bottom end of the paper shifted frontward.

The paper discharging device according to the present invention comprises paper support means for supporting accommodated papers as of the above-mentioned carrying belts, the paper support means including first carrying means for supporting papers arranged on the rear portion of the paper support means, and second carrying means for supporting papers arranged on the front portion of the paper support means, and wherein the second carrying means is driven at a speed higher than that of the first carrying means.

When the paper is being discharged, the paper arranged on these two carrying means in such a position as to decline rearward with the lower end of the paper shifted frontward is carried by these two carrying means from the rear to the front at which the discharging roller is disposed. Under these conditions, at the front near the discharge roller, since the lower end of the paper is carried faster and more strongly in the frontward direction by the second carrying means being driven at a higher speed, the papers are carried toward the front in a rearward-inclined position or if the papers are about to stand up vertically or if the papers have already stood up vertically, it is possible to return the paper to the appropriate rearward-inclined condition. As described above, the papers are rearranged at a correct rearward-inclined condition suitable for the succeeding discharge motion, thus solving the aforementioned problems involved in the prior-art paper discharging device.

DETAILED DESCRIPTION OF THE PREFERRED EMBODIMENTS

The present embodiment relates to a bill discharging device to be incorporated in a bill container. The bill container itself is neither shown nor described.

Figure 1:
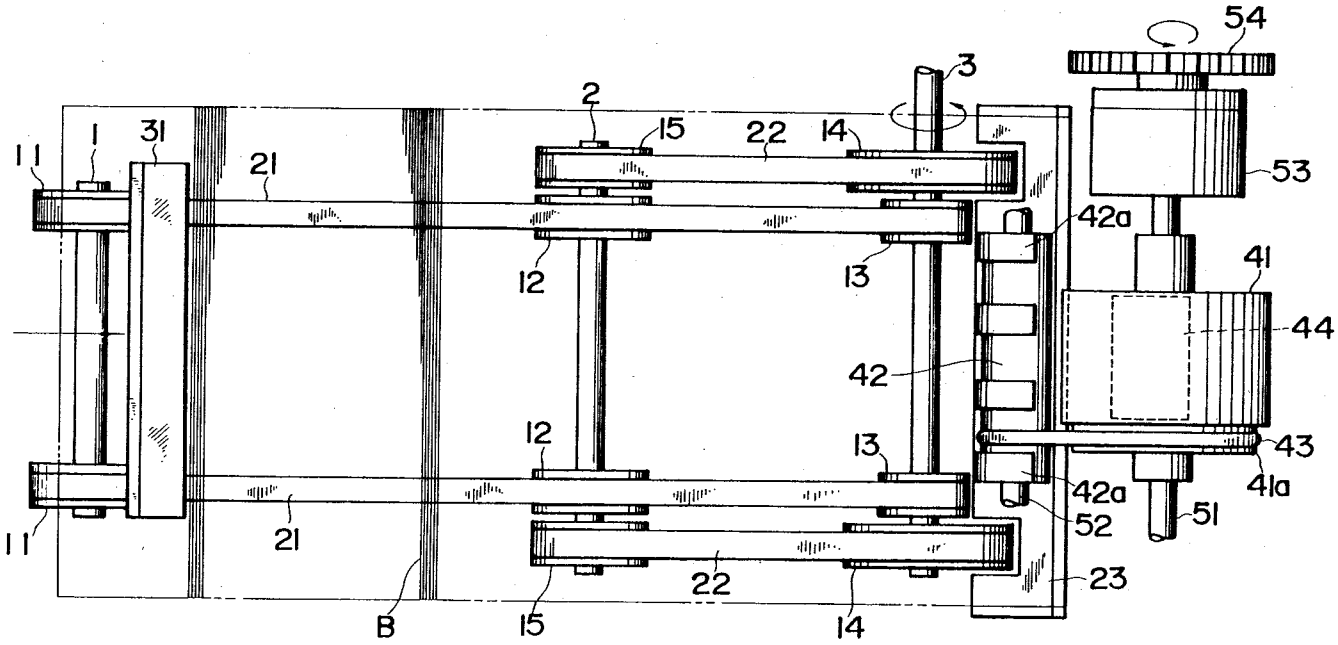
FIG. 1 is a plane view showing the paper discharging device according to the present invention.
Figure 2:
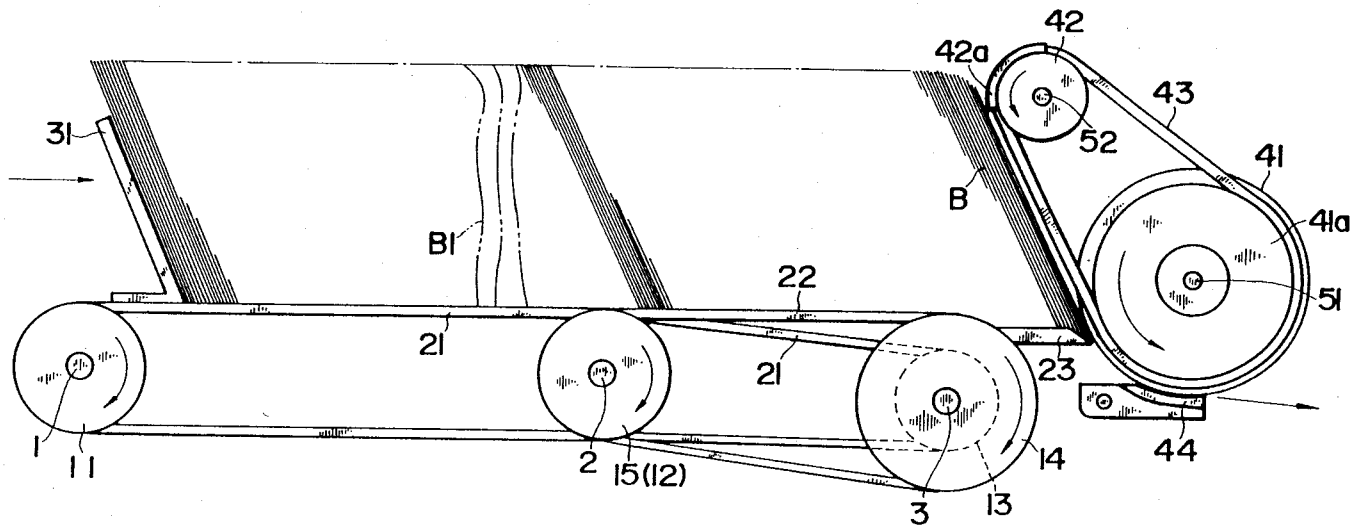
FIG. 2 is a side view of the same device.

With reference to FIGS. 1 and 2, in the direction from the rear side of a container (the leftside in the drawings) to the front side thereof (the rightside therein), two driven shafts 1 and 2 and a driving shaft 3 are rotatably supported by a frame of a bill container. The driving shaft 3 is positioned downward from the height position of the driven shafts 1 and 2 and driven by a driving device (not shown). A pair of right-hand and left-hand large-diameter pulleys 14 are fixed to the driving shaft 3; a pair of right-hand and left-hand small-diameter pulleys 13 are also fixed to the driving shaft 3 inside the two large-diameter pulleys 14. A pair of right-hand and left-hand pulleys 15 are fixed to the driven shaft 2; a pair of right-hand and left-hand pulleys 12 having a diameter equal to that of the pulleys 15 are rotatably supported by the driven shaft 2 inside the two pulleys 15. Further, a pair of pulleys 11 are fixed to the driven shaft 1.

A pair of first right-hand and left-hand bill carrying belts 21 are reeved around th pulleys 11, 12 and 13. Further, on the outside of these two belts 21, a pair of second bill carrying belts 22 are reeved around the pulleys 14 and 15. The belts 21 constitute a first carrying means; the belts 22 constitute a second carrying means, respectively. Since the pulleys 14 around which the carrying belts 22 are reeved are large in diameter and the pulleys 13 around which the carrying belts 21 are reeved are small in diameter, at the front side of the bill container, the upper surfaces of the carrying belts 21 are inclined downward in the frontward direction so as to be positioned downward away from the upper surfaces of the carrying belts 22. The upper surfaces of the rear half of the carrying belts 21 (i.e. portions between the pulleys 11 and the pulleys 12) are flush with the upper surfaces of the carrying belts 22. Bills B mounted on these belts are supported and carried by the belts 21 within the first rear half area (between pulleys 11 and 12) but by the belts 22 within the second front half area (between pulleys 15 and 14).

Since the two kinds of pulleys 13 and 14 are fixed to the same driving shaft 3 and further the pulleys 14 are larger in diameter than the pulleys 13, the belts 22 are driven at a speed higher than that of the belts 21.

On the front side of the pulleys 14, there is arranged an auxiliary reception plate 23 at a position nearly flush with the belt 22. On the rear side of the container, a press plate 31 which declines rearward is disposed movably in both the front and rear directions being urged toward the front side by a spring (not shown). A number of bills B are mounted on the carrying belts 21 and 22 within a space surrounded by a discharge roller 41, an auxiliary roller 42 (both described later) and the press plate 31, and supported thereby at such a position as to decline rearward.

At the front of the auxiliary reception plate 23, a discharge roller 41 is disposed an extremely small distance spaced from the plate 23. This discharge roller 41 is fixed to a driving shaft 51 rotatably supported by the container frame. The whole peripheral surface of this discharge roller 41 is coated by a material such as rubber having a large friction coefficient. It is of course possible to form the entire roller 41 by rubber.

Upward and a little rearward away from the discharge roller 41, there is disposed an auxiliary roller 42 having a diameter smaller than that of the discharge roller 41 and an axial length longer than that of the roller 41. This auxiliary roller 42 is fixed to a driven shaft 52 also rotatably supported by the container frame. As shown by the reference numeral **42*a*, a plurality of rubber members are attached on the outer peripheral surface of the auxiliary roller 42** extending over about 1/3 of the whole circumference thereof (i.e. through 120 degrees).

A belt 43 is reeved around a pulley **41*a* provided fixedly at an end of the discharge roller 41 and a groove formed on the auxiliary roller 42, so that these two rollers 41 and 42** are rotated together in linkage motion.

To the driving shaft 51 of the discharge roller 41, a driving force transmitted from a power source (not shown) through a drive gear 54 is applied via a clutch 53 so as to be engageable therewith or disengageable therefrom.

Under the discharge roller 41, a friction pad 44 is disposed in almost contact relationship to the outer periphery of the roller 41 in order to further reliably discharge bills one by one.

In the above device construction, the bills B can be discharged one by one as follows: when the clutch 53 is engaged with the discharge roller 41 and therefore the discharge roller 41 and the auxiliary roller 42 rotate, the foremost bill declining rearward is shifted downward, in dependence upon a friction force generated between the bill and the rubbers (including rubber members **42*a*) attached on the outer surfaces of these rollers, and then introduced between the discharge roller 41 and the pad 44 to be discharged. If a bill has been discharged, the clutch is disengaged, there exists a short time interval to the succeeding bill discharge operation, while the discharged bill is carried over a distance along a delivery path (not shown). When a plurality of bills are required to be discharged, after a predetermined time has elapsed, the clutch 53 is turned on and the drive gear 54 is engaged with the discharge roller 41 again, so that the above-mentioned operations are repeated. In this embodiment, the auxiliary roller 42 rotates one revolution and the discharge roller 41** rotates half revolution whenever one bill is discharged.

In the above discharge operation, both the low- and high-speed belts 21 and 22 are continuously moving when bills are being discharged. The speed of the high-speed belts 22 is several to ten and several times higher than that of the low-speed belts 21. The speed of the low-speed belts 21 is such that bills on the belts 21 are moved by a distance corresponding to the thickness of a bill whenever a bill is discharged. Bills on the belts 22 are urged against the discharge roller 41 and auxiliary roller 42 by a friction force generated between the lower edge of the arranged bills and the upper surface of the high-speed belts 22, while the bills slide relative to the belts 22 driven in high speed.

During the above-mentioned bill discharge operation, even if some bills stand almost vertically, as shown by the dot-and-dash lines B1 in FIG. 2, due to vibration or other, when the bills reaches the second belts 22 arranged at the front half of the container, since this belt 22 is driven at a high speed, the lower edge of the bills are carried frontward quickly and strongly. Therefore, the vertically standing-up bills are returned to the rearward inclined position suitable for the succeeding bill discharge operation.

I claim:

1. A paper discharging device comprising:

(a) means for supporting papers arranged in a standing position with their top end inclined slightly rearward, said paper supporting means including first paper carrying means for supporting and carrying the papers disposed on a rear portion of said paper supporting means, said first paper carrying means comprising first belts reeved around first pulleys, said first belts extending from the rear to the front of said paper supporting means, and second paper carrying means for supporting and carrying the papers disposed on a front portion of said paper supporting means, said second paper carrying means comprising second belts reeved around second pulleys, said second belts being flush with the rear portion of said first belts, the front portion of said first belts being downwardly inclined relative to the front portion of said second belts and said second belts being driven at a speed greater than the speed of said first belts;

(b) a paper press member for urging the papers arranged on said paper supporting means frontward; and (c) a paper discharging roller arranged in front of said paper supporting means, for discharging the papers on said paper supporting means one by one.

2. The paper discharging device as set forth in claim 1, which further comprises an auxiliary roller disposed above said paper discharging roller and rotated in linkage with said paper discharging roller.

* * * * *